US005175915A

United States Patent [19]

Doyel et al.

[11] Patent Number: 5,175,915

[45] Date of Patent: Jan. 5, 1993

[54] METHOD OF MAKING A PADDED PILLOW WITH AN INFLATABLE INSERT

[76] Inventors: John S. Doyel, 404 W. 20th St., New York, N.Y. 10011; James E. Trapp, 238 Second Ave., Milford, Conn. 06460

[21] Appl. No.: 732,802

[22] Filed: Jul. 19, 1991

[51] Int. Cl.[5] ..... B68G 7/06; A47C 20/02

[52] U.S. Cl. ..... 29/91.1; 29/91; 5/644; 5/645

[58] Field of Search ..... 29/91, 91.1; 5/81 R, 5/434, 489, 490, 491, 441; 112/262.1; 297/391, 392, 393

[56] References Cited

U.S. PATENT DOCUMENTS

| | | | |
|---|---|---|---|
| Re. 29,059 | 12/1976 | Kack et al. | 29/91.1 X |
| 3,443,294 | 5/1969 | George | 29/91.1 |
| 4,773,142 | 9/1988 | Davis et al. | 29/91.1 |

FOREIGN PATENT DOCUMENTS 2134383 8/1984 United Kingdom .

*Primary Examiner*—Mark Rosenbaum
*Assistant Examiner*—Peter Dungba Vo
*Attorney, Agent, or Firm*—Cooper & Dunham

[57] ABSTRACT

A method of making a pillow which has padding as well as an inflatable insert which starts with two integral and identical pieces of cloth and is particularly efficient in terms of the amount of labor and the type of equipment required to produce a high-quality article.

1 Claim, 2 Drawing Sheets

METHOD OF MAKING A PADDED PILLOW WITH AN INFLATABLE INSERT

BACKGROUND AND SUMMARY OF THE INVENTION

The invention is in the field of articles such as pillows or cushions and particularly relates to a padded article of this type which has an inflatable insert and more particularly to a method of making such an article. An example of an article of this general type is illustrated in UK Patent Application GB 2 134 383 A. It is believed that there is still a need for making such articles in a more efficient way, and this invention is directed to meeting such a need.

In an exemplary and non-limiting embodiment described in detail below in connection with the drawings, the invention pertains to a method of making an article such as a pillow or cushion with an inflatable insert and padding which method is particularly efficient in terms of the amount of labor and equipment that may be required and produces a high-quality article.

DETAILED DESCRIPTION

Figure 1:
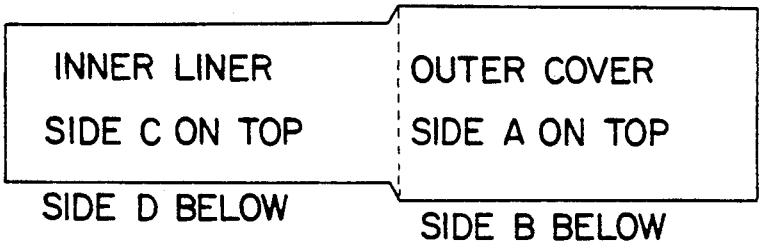
FIGS. 1-9 illustrate consecutive steps of a method of making a pillow in accordance with the invention.

Referring to the drawings, in step 1 two identical pieces of cloth such as cotton are placed on top of each other. Each piece is shaped as illustrated in the top view of FIG. 1, which is approximately to scale, i.e., each has a wider portion on the right and a narrower and somewhat longer portion on the left. The wider portion of the top piece of cloth ultimately forms one side of the outer cover of the pillow, and is designated side A in FIG. 1. The narrower portion of the top piece of cloth ultimately forms one side of an inner liner of the pillow, and is designated side C in FIG. 1. The corresponding portions of the bottom piece of cloth are designated sides B and D, respectively, in FIG. 1, and are directly underneath sides A and C, respectively. Of course, the cloth pieces can be precut in large batches. The structure illustrated in FIG. 1 has upper, lower, left and right edges.

Figure 2:
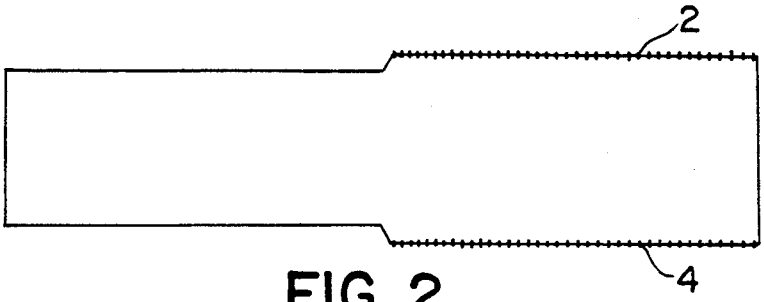

In step 2, the upper and lower edges of the wider portions of the cloth pieces (sides A and B) are overlock stitched at 2 and 4, as illustrated in FIG. 2.

Figure 3:
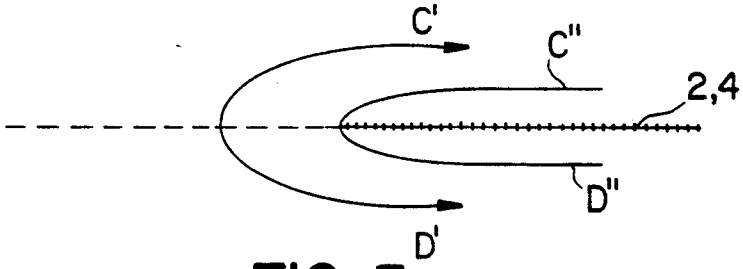
Figure 4:
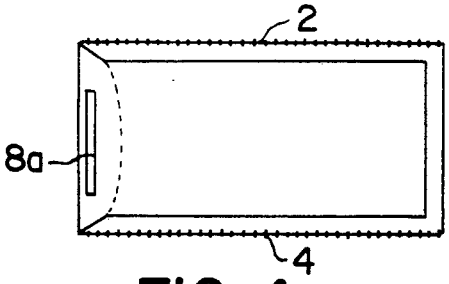

In step 3, the inner liner sides C and D are peeled apart and folded over outer cover sides A and B, respectively, as illustrated in a side view in FIG. 3 at positions C′ and D′ and at positions C″ and D″ of sides C and D, to arrive at the four-layer structure illustrated in FIG. 4.

In step 4*a*, a strip 8*a* of a hook-and-loop material such as Velcro, e.g., a first Velcro loop strip 8*a*, is stitched to the currently upwardly facing surface of side C, near and parallel to the left edge of the structure. The stitching attaches the first Velcro loop strip 8*a* to and through sides A and C, as illustrated in the top view of FIG. 4, but not to or through sides B and D.

In step 4*b*, the four layer structure illustrated in FIG. 4 is turned over, so that the currently exposed surface of side D is on top, and a complementary second strip of a hook-and-loop material such as Velcro, e.g., a second Velcro hook strip 8*b* (not visible in FIG. 4), is stitched to the currently upwardly facing surface of side D, near and parallel to the left edge of the structure. This stitching attaches the second Velcro hook strip 8*b* to and through sides D and B but not to or through sides A and C.

Figure 5:
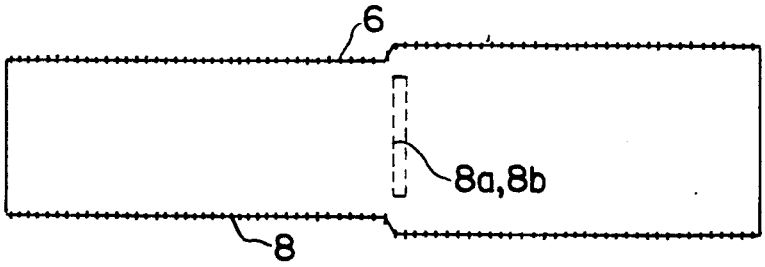

In step 5, inner liner sides C and D are pulled back from outer cover sides A and C, respectively, so that liner sides C and D are over each other and the Velcro strips 8*a* and 8*b* are aligned with each other and are immediately adjacent to each other and face each other. Of course, there is a small fold where strips 8*a* and 8*b* are each attached to two layers of cloth. At this time, the edges which currently are upper and lower edges 6 and 8 of inner liner sides C and D are overlock stitched as illustrated in FIG. 5.

Figure 6:
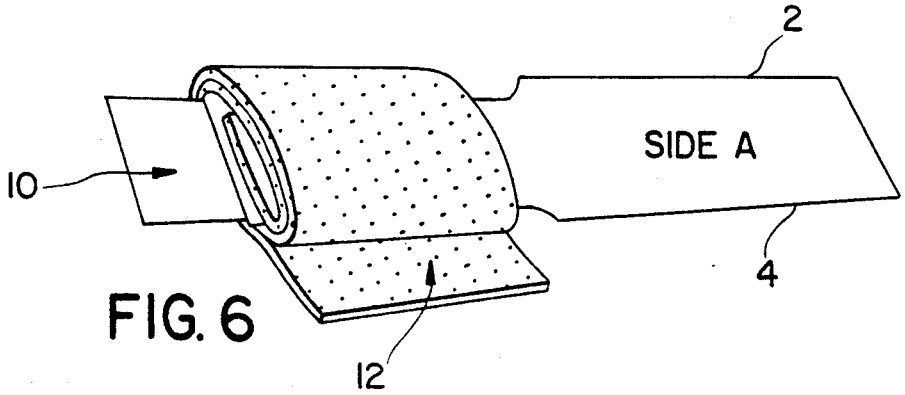

In step 6, a middle stiffening board 10 is inserted between inner liner sides C and D, from the left side as seen in FIG. 6, and padding material is added, for example by wrapping a ½ inch thick strip 12 of soft foam several times around the currently exposed surfaces of inner liner sides C and D as illustrated in FIG. 6. Middle stiffening board 10 can be made of a material such as wood or plastic and is somewhat longer than the left-right length of inner liner sides C and D so that it can be extent through the entire length of the inner liner sides C and D and still leave an exposed part that can be grasped by hand. Of course, board 10 should be somewhat narrower than the space between the stitched upper and lower edges of sides C and D so that it can be easily inserted between sides C and D, and should be sufficiently light in weight to be easily manipulated by hand. How many layers of foam are wrapped, or what thickness and softness of foam (or other similar material) are used depends on factors such as how soft or firm the pillow or cushion should be.

Figure 7:
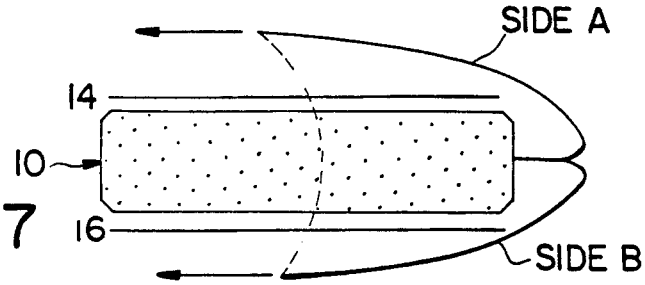

In step 7, middle stiffening board 10 is left in place and top and bottom stiffening boards 14 and 16 are placed over and under the wrapped foam 12, respectively, as illustrated in FIG. 7. Boards 14 and 16 can but need not be identical to board 10. Once all boards 10, 14 and 16 are in place, outer covers A and B are pulled over top and bottom boards 14 and 16, as illustrated in FIG. 7, until the edges of all four sides A–D which are currently at the left of FIG. 7, are aligned with each other.

Figure 8:
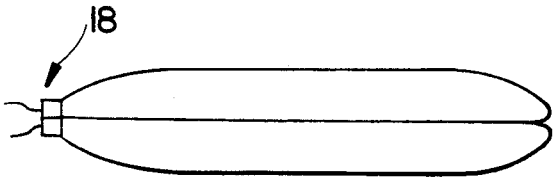
Figure 9:
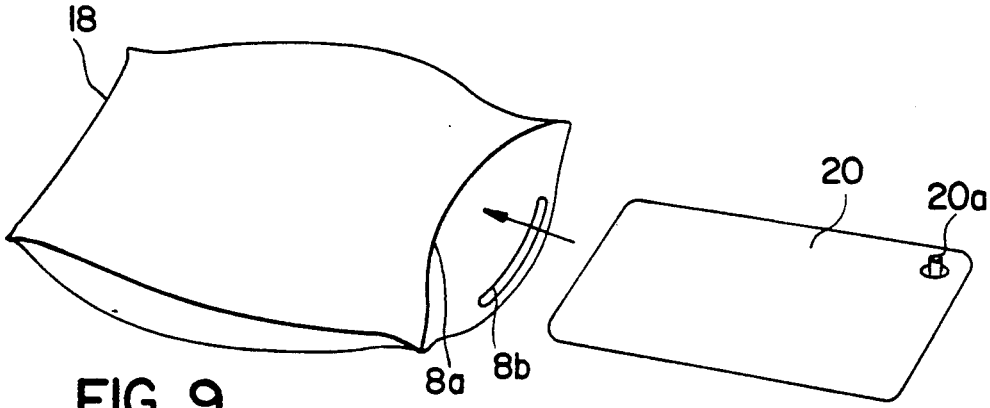

In step 8, the stiffening boards are removed by pulling them to the left in FIG. 8, and the left edges of sides A-D are pulled even and are sewn together, e.g., with an overlock stitch at 18, as illustrated in FIG. 8, to seal the left end of the pillow. At this time, the overlock stitch at the left edge of the pillow shows but the overlock stitches at the upper and lower edges of outer cover sides A and B do not show. Also at this time, the right edge of the pillow has a central opening between sides C and D, and the facing strips of Velcro 8*a* and 8*b* are just inside this opening.

In step 9, an inflatable insert 20 is inserted into the space between the facing surfaces of inner liner sides C and D and the pillow is closed by pressing together Velcro strips 8*a* and 8*b*. Insert 20 is somewhat shorter than the length of sides C and D so that it can easily fit between sides C and D, inside (to the left of) Velcro strips 8*a* and 8*b*, and has a valve 20*a* through which insert 20 can be inflated with air or some other fluid to the desirable pressure either before it is inserted into the pillow or after it is partly or fully inserted.

I claim:

1. A method of making a pillow comprising the steps of:

placing an integral top piece of cloth having an outer cover slide A and an inner liner side C over a bottom piece of cloth having matching sides B and D, respectively, to form a two-layer structure in which each of said sides A, B, C and D has an upper, lower, left and right edge;

stitching the upper edges of sides A and B to each other and stitching the lower edges of sides A and B to each other;

folding side C over side A and folding side D over side B to form a structure of four layers of cloth which has a left edges at which a fold line where sides A and C join is over a fold line where sides B and D join, and attaching a first strip of hook-and-loop material to sides A and C only at the left edge of the four-layer structure such that the first strip extends along the left edge of the four-layer structure and faces away from the four-layer structure, and attaching a second strip of hook-and-loop material to sides B and D only at the left edge of the four-layer structure such that the second strip extends along the left edge of the four-layer structure and faces away from the four-layer structure and from the first strip, said first and second strips being complementary and adapted to lock to each other when pressed together;

unfolding sides C and D so that they again are over each other and sides A, B, C and D form a two-layer structure and so that the first and second strips are immediately adjacent to and face each other, and stitching the lower edges of sides C and D to each other;

inserting a middle stiffening board between sides C and D and wrapping padding over sides C and D;

placing a top stiffening board over the padding which is over side C and a bottom stiffening board over the padding which is over side D, and pulling sides A and B over the top and bottom stiffening boards, respectively, to again make sides A, B, C and D form a four-layer structure but this time with sides A and B being on the outside;

removing the stiffening boards and sewing together the edges of sides A, B, C, and D which are opposite the edges at which said first and second strips of hook-and-loop material are attached; and inserting the inflatable insert between sides C and D and closing the pillow by pressing together the first and second strips of hook-and-loop material to thereby enclose the insert.

* * * * *